US006704528B1

(12) United States Patent
Kawamura et al.

(10) Patent No.: US 6,704,528 B1
(45) Date of Patent: Mar. 9, 2004

(54) IMAGE FORMING APPARATUS HAVING DETACHABLE CLEANING UNIT

(75) Inventors: Hiroshi Kawamura, Numazu (JP); Hiroshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/612,293

(22) Filed: Jul. 7, 2000

(30) Foreign Application Priority Data

Jul. 8, 1999 (JP) ..... 11-194231
Jun. 23, 2000 (JP) ..... 2000-190038

(51) Int. Cl.[7] ..... G03G 15/20
(52) U.S. Cl. ..... 399/123; 399/101
(58) Field of Search ..... 399/101, 165, 399/350, 353, 162, 123

(56) References Cited

U.S. PATENT DOCUMENTS 4,924,272 A * 5/1990 Hediger et al. ..... 399/123
5,258,816 A * 11/1993 Haneda et al. ..... 399/165
5,708,928 A * 1/1998 Fukunaga ..... 399/123
5,870,650 A * 2/1999 Takahashi et al. ..... 399/98
5,907,752 A * 5/1999 Kondoh ..... 399/120
6,029,033 A * 2/2000 Kawasaki ..... 399/149

FOREIGN PATENT DOCUMENTS

JP 04060575 * 2/1992
JP 5-289426 11/1993
JP 10-326068 * 12/1998
JP 11-002936 * 1/1999

* cited by examiner

*Primary Examiner*—Robert Beatty
(74) *Attorney, Agent, or Firm*—Fitzpatrick, Cella, Harper & Scinto

(57) ABSTRACT

An image forming apparatus comprises a belt member, a roller for supporting the belt member, a retainer for retaining a rotating shaft of the roller such that the roller retained by the retainer can be moved only in a predetermined one direction, an image forming device for forming an image on the belt member, wherein the image formed on the belt member by the image forming device is transferred to a recording material, and a detachable cleaning unit having a cleaning member for cleaning the belt member in contact with a surface of the belt member supported by the roller, wherein the cleaning unit is positioned by the retainer.

26 Claims, 9 Drawing Sheets

IMAGE FORMING APPARATUS HAVING DETACHABLE CLEANING UNIT

BACKGROUND OF THE INVENTION

1. Field of the Invention

The present invention relates to an image forming apparatus using an electrophotographic process such as a copying machine, a printer, a facsimile telegraph, etc.

2. Related Background Art

For example, the construction of an image forming apparatus using an intermediate transfer member is adopted in an image forming apparatus having a full color or multiplex image forming function in many cases.

In this image forming apparatus, component color toner images corresponding to plural color component images of a full color image or a multiplex image as an object are sequentially formed on a first image bearing member such as an electrophotographic photosensitive member, an electrostatic recording dielectric, etc. by suitable image forming process means. These component color toner images are sequentially superimposed and transferred to the intermediate transfer member as a second image bearing member being generally of a rotary belt type by a primary transfer portion. Thus, a full color image and a multiplex toner image corresponding to the full color image and the multiplex image as an object are synthesized and formed on the intermediate transfer member. The toner image synthesized and formed on this intermediate transfer member is transferred to a transfer material by a secondary transfer portion. This transfer material is guided to a fixing portion and the image is fixed so that a full color image forming object is obtained.

Here, the image forming apparatus adopting an intermediate transfer belt as the second image bearing member (intermediate transfer member) will be explained with reference to FIG. 11. FIG. 11 shows the image forming apparatus with an intermediate transfer unit 120 and a cleaner unit 112 as centers, and shows only one of plural image forming portions.

Component color toner images corresponding to plural color component images formed on an image bearing member 101 are sequentially superimposed and transferred by a primary transfer portion T1 nipped between the image bearing member 101 and a primary transfer opposite roller 102. Thus, a full color image as an object is formed on an intermediate transfer belt 103. This full color image on the intermediate transfer belt 103 is collectively transferred to a transfer material P by a secondary transfer portion T2 formed by a secondary transfer roller 118 and a secondary transfer opposite roller 105. The full color image is then fixed by an unillustrated fixing portion so that a full color forming object is obtained.

The intermediate transfer unit 120 is composed of the primary transfer opposite roller 102, the intermediate transfer belt 103, rollers of three shafts for supporting the intermediate transfer belt 103, i.e., a drive roller 104, the secondary transfer opposite roller 105, and a tension roller 106 as a movable roller. The intermediate transfer unit 120 can be detachably attached to an apparatus main body.

Tensile force of the intermediate transfer belt 103 is constantly maintained by pressurizing a bearing 107 of the swingable tension roller 106 by a compressing spring 108.

The cleaner unit 112 is arranged around the intermediate transfer belt 103 and cleans toner not transferred in the secondary transfer but left as the residual transfer remaining on the intermediate transfer belt 103. The cleaner unit 112 has a cleaning blade 111 abutting on the intermediate transfer belt 103, and a cleaner container 110 for containing the remaining toner removed by the cleaning blade 111. The cleaning blade 111 is retained by the cleaner container 110. A backup roller 109 is arranged in an opposite portion of the cleaning blade 111. The cleaner unit 112 and the backup roller 109 are fixed to the apparatus main body or the intermediate transfer unit 120.

Japanese Patent Application Laid-open No. 5-289426 discloses a cleaning blade arranged such that the cleaning blade is opposed to a tension roller for tensioning a photosensitive belt. A photosensitive member unit having first and second casing members is disclosed more particularly. A shaft of a drive roller for driving the photosensitive belt and a shaft of an exposure roller for supporting an exposure position of the photosensitive belt are assembled into the first casing member. A charger for charging the photosensitive belt and a cleaning blade for cleaning the photosensitive belt are assembled into the second casing member.

Further, it is also disclosed that a shaft of the tension roller is guided to an elongated hole formed in the first casing member and is also guided to an elongated hole formed in the second casing member.

However, the following problems exist in the above conventional example since the cleaner unit 112 of the intermediate transfer belt 103 is fixed to the main body or the intermediate transfer unit 120.

(1) The tension roller 106 for maintaining the tensile force of the intermediate transfer belt 103 constant and a roller for controlling the deviation of the belt are movable to make an alignment adjustment. Therefore, the position of a surface of the intermediate transfer belt 103 is also changed in accordance with the positions of the movable rollers. In such a case, the cleaning blade 111 does not abut against the intermediate transfer belt 103 depending on the position of the surface of the intermediate transfer belt 103, and hence the cleaning blade 111 does not fulfil its role as a cleaner. Further, the backup roller 109 is required in the opposite portion of the cleaning blade 111 so that the number of parts is increased and the construction becomes complicated.

(2) When the cleaner unit 112 is fixed to the intermediate transfer unit 120 and when one of the intermediate transfer belt 103 and the cleaner unit 112 is exchanged by life, etc., both the units must be simultaneously exchanged, which is not economical and efficient.

In the image forming apparatus disclosed in Japanese Patent Application Laid-open No. 5-289426, the tension roller is displaced in two directions and these two directions are not perpendicular to each other at any time. Accordingly, when the tension roller is displaced, abutting positions of the tension roller and a tip of the cleaning blade abutting through the photosensitive belt are changed. Namely, an abutting angle of the cleaning blade on the photosensitive belt and an inroad amount of the cleaning blade tip are changed. Therefore, there is a fear of generation of a cleaning defect in which toner passes through the cleaning blade, etc.

SUMMARY OF THE INVENTION

An object of the present invention is to provide an image forming apparatus for preferably maintaining a contact state of a cleaning member and a belt member and able to prevent the generation of a cleaning defect even when a roller for supporting the belt member is moved.

The other objects of the present invention will become apparent by reading the following detailed explanation.

DESCRIPTION OF THE PREFERRED EMBODIMENTS

The embodiments of the present invention will next be described with reference to the drawings.

First Embodiment

[Description of Entire Image Forming Apparatus]

Figure 1:
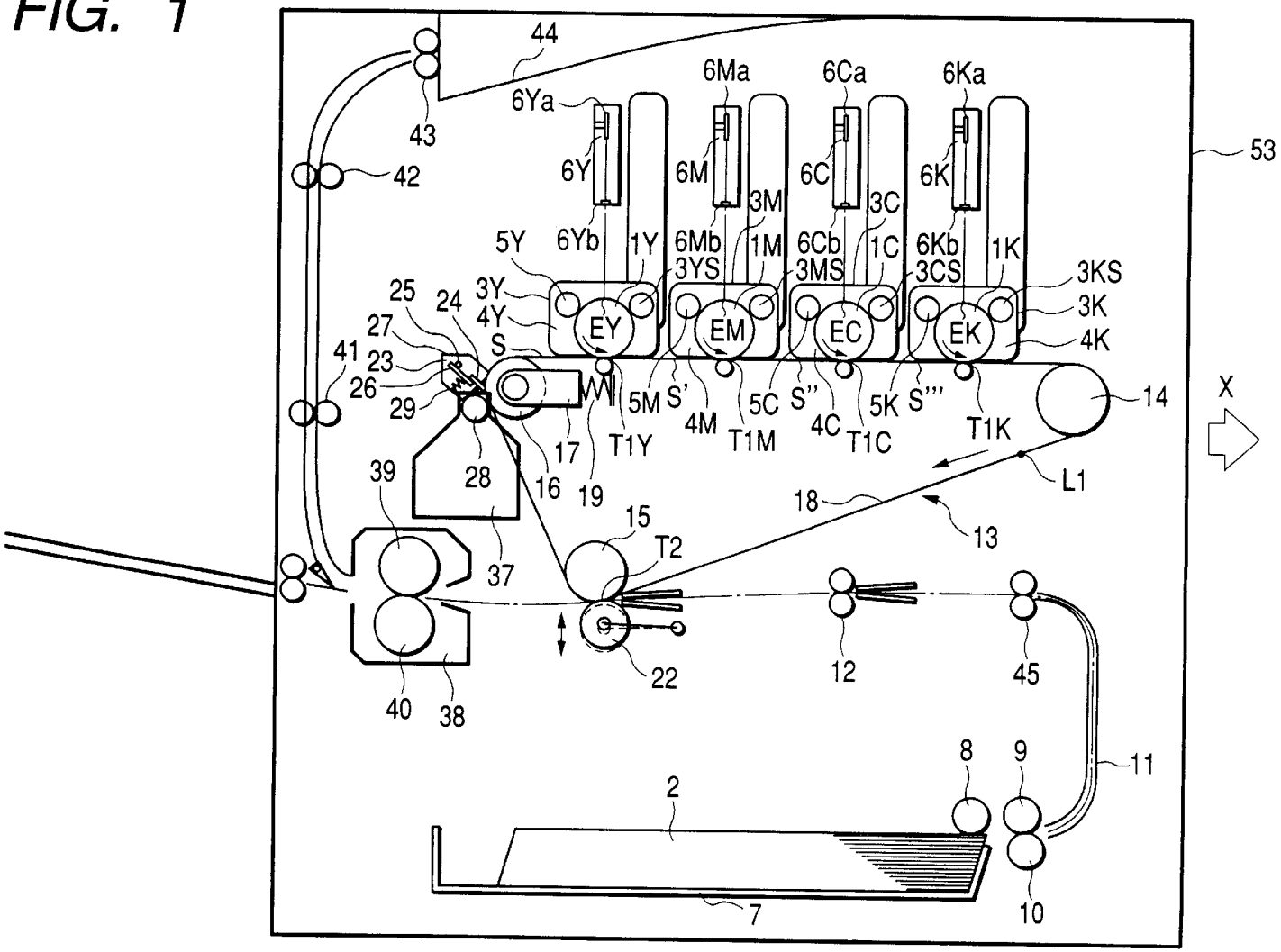
FIG. 1 is a main sectional view schematically showing the entire construction of an image forming apparatus.

The entire construction of a color image forming apparatus will first be schematically explained with reference to FIG. 1. FIG. 1 is a view for explaining the entire construction of a laser beam printer in one mode of the color image forming apparatus.

As shown in FIG. 1, the color laser beam printer is constructed by, an image forming portion having image bearing members 1 (1Y, 1M, 1C, 1K) and color developing devices, and an intermediate transfer member. The image bearing member 1 is rotated at a constant speed every each color of Y(yellow), M(magenta), C(cyan) and Bk(black). The intermediate transfer member retains a color image developed by the image forming portion and multiplexed and transferred, and further transfers the color image to a transfer material 2 as a recording material fed from a feeding portion. The transfer material 2 having the transferred color image is next conveyed to a fixing portion 38 and the color image is fixed to the transfer material 2. Thus, the transfer material 2 is discharged to a discharge portion 44 on an upper face of the image forming apparatus by discharge rollers. The above color developing device of each of the four colors is individually detachably attached to a printer main body.

The construction of image forming means of the above image forming apparatus will next be explained sequentially in detail.

[Image Bearing Member]

An image bearing member (photosensitive drum) 1 is constructed integrally with a container 3 of a holder of the developing device. A developing unit 4 is detachably supported by the printer main body and can be easily exchanged in accordance with life of the image bearing member 1. The image bearing member (photosensitive drum) 1 in this embodiment is coated with an organic photoconductive layer outside an aluminum cylinder, and is rotatably supported by the container 3 of the holder of the image bearing member 1. Driving force of an unillustrated drive motor is transmitted to one rear end of the image bearing member in FIG. 1 so that the image bearing member 1 is rotated in the counterclockwise direction in FIG. 1 in accordance with an image forming operation.

[Charging Means]

Charging means 5 uses an injection charging method in which a surface of the image bearing member 1 is uniformly charged by an applied voltage of a charging sleeve through a charging agent.

[Exposure Means]

The above image bearing member 1 is exposed from a scanner portion 6. Namely, when an image signal is given to a laser diode, this laser diode irradiates image light corresponding to the image signal to a polygon mirror 6*a*. This polygon mirror 6*a* is rotated at a high speed by a scanner motor. The image light reflected on the polygon mirror 6*a* selectively exposes the surface of the image bearing member 1 rotating at a constant speed through an imaging lens 6*b* so that an electrostatic latent image is formed on the image bearing member.

[Developing Means]

Developing means is constructed by four developing devices 4Y, 4M, 4C, 4K able to develop the respective colors of yellow, magenta, cyan and black to visualize the above electrostatic latent image. In the respective developing devices 4Y, 4M, 4C, 4K of the four colors, sleeves 3YS, 3MS, 3CS, 3KS are arranged in positions each opposed to the image bearing member 1 at small intervals with respect to the image bearing member 1, and a visual image is formed by the toner of each color on the image bearing member 1.

The developer 4 of each color feeds the toner within the container by a feeding mechanism, and coats an outer circumference of the sleeve 3S rotating in the clockwise direction in FIG. 1 with mixing powder of the (nonmagnetic) toner and a (magnetic) developer. Thereafter, the toner within the powder is developed in accordance with the electrostatic latent image of the image bearing member 1.

[Intermediate Transfer Member Unit]

An intermediate transfer unit 13 has an intermediate transfer member 18 as a belt member, a drive roller 14 for tensioning the intermediate transfer member 18, a secondary transfer opposite roller 15 and a tension roller 16. The intermediate transfer member 18 is rotated in the clockwise direction in FIG. 1 in synchronizm with a peripheral speed of the image bearing member 1 to multiplex and transfer the toner image on the image bearing member 1 visualized by each developing device at the time of a color image forming operation. The transfer member 2 is nipped and conveyed by the multiplexed and transferred intermediate transfer member 18 and a secondary transfer roller 22 to which a voltage is applied. Thus, the color toner images on the intermediate transfer member are simultaneously multiplexed and transferred to the transfer member 2.

The intermediate transfer member 18 in this embodiment is formed by a resin belt having about 1000 mm in circumferential length, and is tensioned by three shafts of the drive roller 14, the secondary transfer opposite roller 15 and the tension roller 16. The intermediate transfer member 18 is loaded by a spring 19 at each of both ends of the tension roller 16 so that a changing amount of the circumferential length of the intermediate transfer member 18 can be absorbed even when the circumferential length of the intermediate transfer member 18 is changed by temperature and humidity within the main body or by variation per hour. This intermediate transfer member 18 is supported by the main body with the drive roller as a fulcrum, and the driving force of an unillustrated drive motor is transmitted to one rear end of the drive roller in FIG. 1. Thus, the intermediate transfer member 18 is rotated in the clockwise direction in FIG. 1 in accordance with the image forming operation. Further, this intermediate transfer member 18 can be attached to be easily detached in a rightward direction in FIG. 1.

[Feeding Portion]

A feeding portion feeds the transfer material 2 to the image forming portion. The feeding portion is mainly constructed by a cassette 7 for containing plural sheets of transfer material 2, a pickup roller 8, a feeding roller 9, a retard roller 10 for double feed prevention, a feeding guide 11 and a registration roller 12. When an image is formed, the pickup roller 8 is rotated in accordance with the image forming operation, and separates and feeds the transfer materials 2 within the cassette 7 one by one. The transfer material 2 is guided by a guide plate 11 and reaches the registration roller 12 via a conveying roller. While the image forming operation is performed, the registration roller 12 performs a non-rotating operation and a rotating operation in a predetermined sequence. In the non-rotating operation, the transfer material 2 is at rest and is on standby. In the rotating operation, the transfer material 2 is conveyed toward the intermediate transfer member. Positions of the image and the transfer material 2 are aligned with each other by the registration roller 12 at the time of a transfer process as the next process.

[Transfer Portion]

A transfer portion is constructed by a swingable transfer roller 22. The transfer roller 22 is constructed by winding a metallic shaft by a medium-resistance foam elastic material, and can be moved upward and downward in FIG. 1 and is operated. While toner images of the four colors are formed on the above intermediate transfer member 18, i.e., until the toner images on the intermediate transfer member 18 reach the secondary transfer portion, the transfer roller 22 is located downward and is separated from the intermediate transfer member 18 as shown by a dotted line in FIG. 1 so as not to disturb these images. Thereafter, the transfer roller 22 is located by an unillustrated cam member in an upward position shown by a solid line in FIG. 1, i.e., is pressed against the intermediate transfer member 9 through the transfer member 2 by a predetermined pressure in synchronizm with transfer timing of a color image onto the transfer material 2. At this time, a bias voltage is simultaneously applied to the transfer roller 22, and the toner images on the intermediate transfer member 18 are transferred to the transfer material 2. Here, since the intermediate transfer member 18 and the transfer roller 22 are respectively operated, the transfer process is performed in the transfer material 2 nipped by both the intermediate transfer member 18 and the transfer roller 22. Simultaneously, the transfer material 2 is conveyed at a predetermined speed in a leftward direction in FIG. 1 and is sent to the fixing device in the next process.

[Intermediate Transfer Member Cleaning Unit]

An intermediate transfer member cleaning unit 23 is constructed by a cleaning blade 24, a pressurizing spring 29 for pressing the cleaning blade 24 against the intermediate transfer member 18, and a cleaner container 27 for retaining these members.

A material of the cleaning blade 24 is urethane rubber and is formed on a metallic plate 26. A shaft 25 retained by the cleaner container 27 is set to a center of rotation, and the cleaning blade 24 is pressed against the intermediate transfer member 18 by the pressurizing spring 29 at a predetermined angle (counter abutting). Therefore, the cleaning blade 24 can uniformly abut against the intermediate transfer member 18. The tension roller 16 as a backup roller is arranged in an opposite portion of the cleaning blade 24 so that the cleaning blade 24 can abut against the intermediate transfer member 18 by a predetermined abutting pressure. At a portion in which this cleaning blade 24 abuts against the intermediate transfer member 18, the toner is scraped off from the intermediate transfer member 18 and the intermediate transfer member 18 is cleaned.

As will be described later, the tension roller can be moved in only one direction to increase or decrease tension of the belt.

The waste toner scraped off by the cleaning blade 24 is collected in the cleaner container 27 and is then sent and collected in a waste toner box 37 separately arranged within the main body by a screw 28 arranged in a lowermost portion of the cleaner container 27. This screw 28 is rotated in its conveying direction by the driving force of an unillustrated drive motor transmitted to one rear end of the screw 28 in FIG. 1.

[Fixing Portion]

The toner image formed by the above developing means is transferred onto the transfer material 2 through the intermediate transfer member 18. The fixing portion 38 fixes the transferred toner image to the transfer material 2. As shown in FIG. 1, the fixing portion 38 is constructed by a fixing roller 39 for heating the transfer material 2, and a pressure roller 40 for making the transfer member 2 come in press contact with the fixing roller 39. Each of these rollers is a hollow roller and an unillustrated heater is arranged within each of these rollers. Each of these rollers is rotated and simultaneously conveys the transfer material 2. Namely, the transfer material 2 retaining the toner image is conveyed by the fixing roller 39 and the pressure roller 40, and is heated and pressurized so that the toner is fixed to the transfer material 2.

[Image Forming Operation]

The image forming operation of the image forming apparatus having the above construction will next be explained.

First, the pickup roller 8 shown in FIG. 1 is rotated and one transfer material 2 within the sheet feed cassette 7 is separated and conveyed to the registration roller 12.

Each of the image bearing member 1 and the intermediate transfer member 18 is rotated at a peripheral speed V (hereinafter referred to as a process speed) in the direction of an arrow shown in FIG. 1.

When a peripheral arbitrary point of the intermediate transfer member in FIG. 1 reaches an S-position in FIG. 1, the image bearing member 1 having a surface uniformly charged by the charging means is exposed by a laser beam in an E-position in FIG. 1 so that an image is formed. A distance from the exposure position E of the image bearing member 1 to a contact portion T1 with the intermediate transfer member 18 in the counterclockwise direction is equal to a distance from the S-point of the intermediate transfer member 18 in FIG. 1 to the contact portion T1. Accordingly, after a period of time has elapsed, a write starting point E of the image and the point S on the intermediate transfer member 18 are in conformity with each other in a position of the contact portion T1. Namely, the image is formed in the counterclockwise direction on the intermediate transfer member 18 with the S-point as an image tip.

1: Formation of a Yellow Image

A laser beam of a yellow image is irradiated by a scanner portion 6Y so that a yellow latent image is formed on an image bearing member 1Y. Simultaneously, a yellow developing device 4Y is operated and a voltage having the same polarity as a charging polarity of the image bearing member 1Y and approximately having the same electric potential as the image bearing member 1Y is applied to the yellow developing device 4Y such that a yellow toner is attached to the latent image on the image bearing member 1Y. Thus, the yellow toner is developed. Simultaneously, the yellow toner image on the image bearing member 1Y is primarily transferred to an outer circumference of the intermediate transfer member 18 in a primary transfer position T1Y in the downstream of a developing portion. At this point, the intermediate transfer member 18 performs a primary transfer operation by applying a voltage having characteristics reverse to those of the above yellow toner to a primary transfer roller arranged on a back surface of the intermediate transfer member 18.

When the formed image has a size of A3 having 420 mm in length, the image is formed from a peripheral S-point of the intermediate transfer member 18 to a point L1.

2: Formation of a Magenta Image

When one peripheral point S (a tip of the yellow image) of the intermediate transfer member 18 next reaches the position of an S'-point in FIG. 1, the irradiation of a laser beam of a magenta image is similarly started by a scanner portion 6M. Thus, similar to the yellow image, a magenta toner image is developed in a latent image on an image bearing member 1M. The magenta toner image on the image bearing member 1M is transferred onto the intermediate transfer member 18 in a primary transfer position T1M.

3: Formation of a Cyan Image

When one peripheral point S (tips of the yellow and magenta images) of the intermediate transfer member 18 next reaches the position of a point S" in FIG. 1, the irradiation of a laser beam of a cyan image is similarly started by a scanner portion 6C. Thus, similar to the magenta image, a cyan toner image is developed in a latent image on an image bearing member 1C. The cyan toner image on the image bearing member 1C is superimposed and transferred onto the yellow and magenta toner images on the intermediate transfer member 18 in a primary transfer position TiC.

4: Formation of a Black Image

When one peripheral point S (tips of the yellow, magenta and cyan images) of the intermediate transfer member 18 next reaches the position of a point S'" in FIG. 1, the irradiation of a laser beam of a black image is similarly started by a scanner portion 6K. Similar to the cyan image, a black toner image is developed in a latent image on an image bearing member 1K. The black toner image on the image bearing member 1K is further superimposed and transferred onto the intermediate transfer member 18 in a primary transfer position T1K.

As mentioned above, the latent image formation and the development are performed in the order of yellow, magenta, cyan and black, and the toner is transferred to the intermediate transfer member 18 in each of the primary transfer positions T1Y, T1M, T1C and T1K. Thus, a full color image constructed by the toners of four kinds of yellow, magenta, cyan and black is formed on a surface of the intermediate transfer member 18.

The transfer material 2 on standby in the above registration roller begins to be synchronously conveyed before the black toner is completely transferred to the intermediate transfer member 18, i.e., before the primary transfer of the black toner of the fourth color is completed and before an image tip S of the intermediate transfer member 18 forming the full color image thereon reaches a secondary transfer portion T2. When the image of each of the above four colors is formed on the intermediate transfer member 18, the transfer roller 22 is on standby downward and does not come in contact with the intermediate transfer member 18. This transfer roller 22 is simultaneously moved upward by an unillustrated cam, and the transfer material 2 comes in press contact with the secondary transfer portion T2 of the intermediate transfer member 18. Simultaneously, a bias voltage having characteristics reverse to those of the toner is applied to the transfer roller 22. Thus, the four colors of the full color image on the intermediate transfer member 18 are simultaneously transferred to the transfer material 2. The transfer material 2 passing through the secondary transfer portion T2 is separated from the intermediate transfer member 18 and is conveyed to the fixing portion 38 and the toner is fixed. Thereafter, the transfer material 2 is discharged onto a discharge tray 44 in an upper portion of the main body through discharge roller pairs 41, 42, 43 such that an image face of the transfer material 2 is directed downward. Thus, the image forming operation is terminated.

Figure 2:
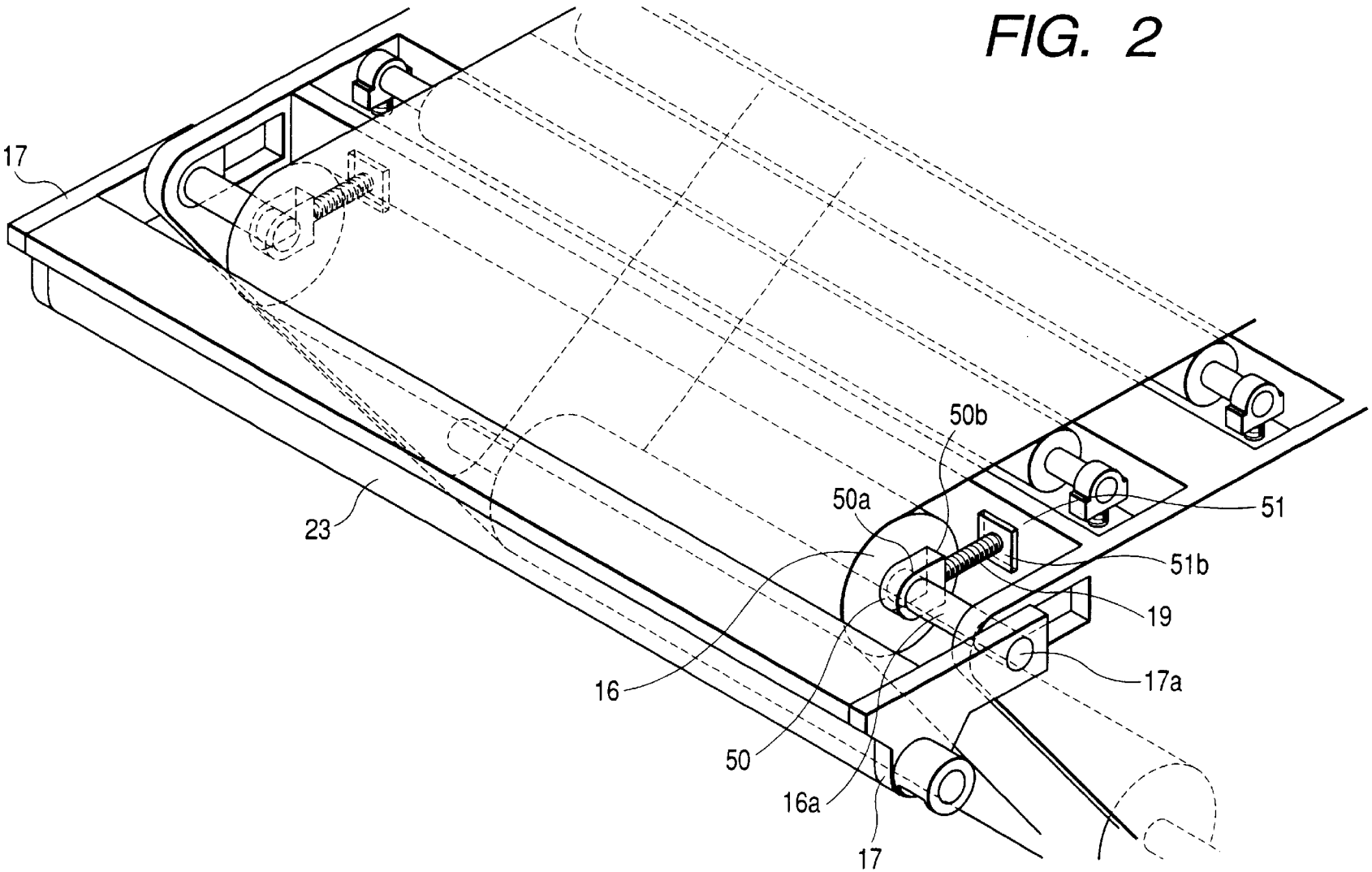
FIG. 2 is a perspective view showing the construction of a tension roller of the present invention.

FIG. 2 is a perspective view of a tension giving mechanism portion of the intermediate transfer belt unit 13 in an embodiment of the present invention. Reference numeral 50 designates a tension bearing rotatably fitted onto a shaft 16*a* of the tension roller 16. Similar to the conventional example, a compressing spring 19 is attached by a predetermined pressure between an end face 50*b* of the tension bearing 50 and a wall face 51*b* of a frame 51. A material of the tension bearing 50 is formed by using a conductive polyacetal resin as in the conventional example so that the tension roller is electrically connected to the ground. Similar to the conventional example, a tensioner 17 and the shaft 16*a* of the tension roller 16 are slidably rotated, but a load applied to an inner wall of a bearing portion of the tensioner 17 is reduced and there is almost no wearing on an inner wall face. In contrast to this, the inner wall 50*a* of the tension bearing 50 and the tension roller shaft 16*a* are worn as in the conventional example, but there is no change in the position relation of the tensioner 17 and the tension roller 16, and there is also no change in the relative position relation of the tension roller 16 and the blade 24. An attachment size of the compressing spring 19 is slightly changed by this wearing, but no belt is slipped by a reduction in pressure due to a changing amount of this attachment size.

The conductive polyacetal resin is used in the material of the tension bearing. However, for example, similar effects can also be obtained even when an oil-impregnating sintering material of iron and copper groups is used.

Further, the intermediate transfer unit 13 has both side plates arranged on both end sides of the intermediate transfer member 18 in a thrust direction and respectively securely supporting both end portions of rotating shafts of the drive roller 14 and the secondary transfer opposite roller 15. After the intermediate transfer unit is moved downward in FIG. 1 and after the intermediate transfer belt is separated from each photosensitive drum, the intermediate transfer unit can be detachably attached to the apparatus main body from an X-direction in FIG. 1. The tensioners 17, 17' are supported by elongated holes formed in the above both side plates through the rotating shaft 16*a* of the tension roller 16. A longitudinal direction of each of the elongated holes formed in the both side plates is approximately equal to a direction in which the intermediate transfer belt is tensioned by the tension roller 16 (compression spring 19).

A central construction of the present invention will next be described in detail by using FIGS. 3 to 8.

Figure 3:
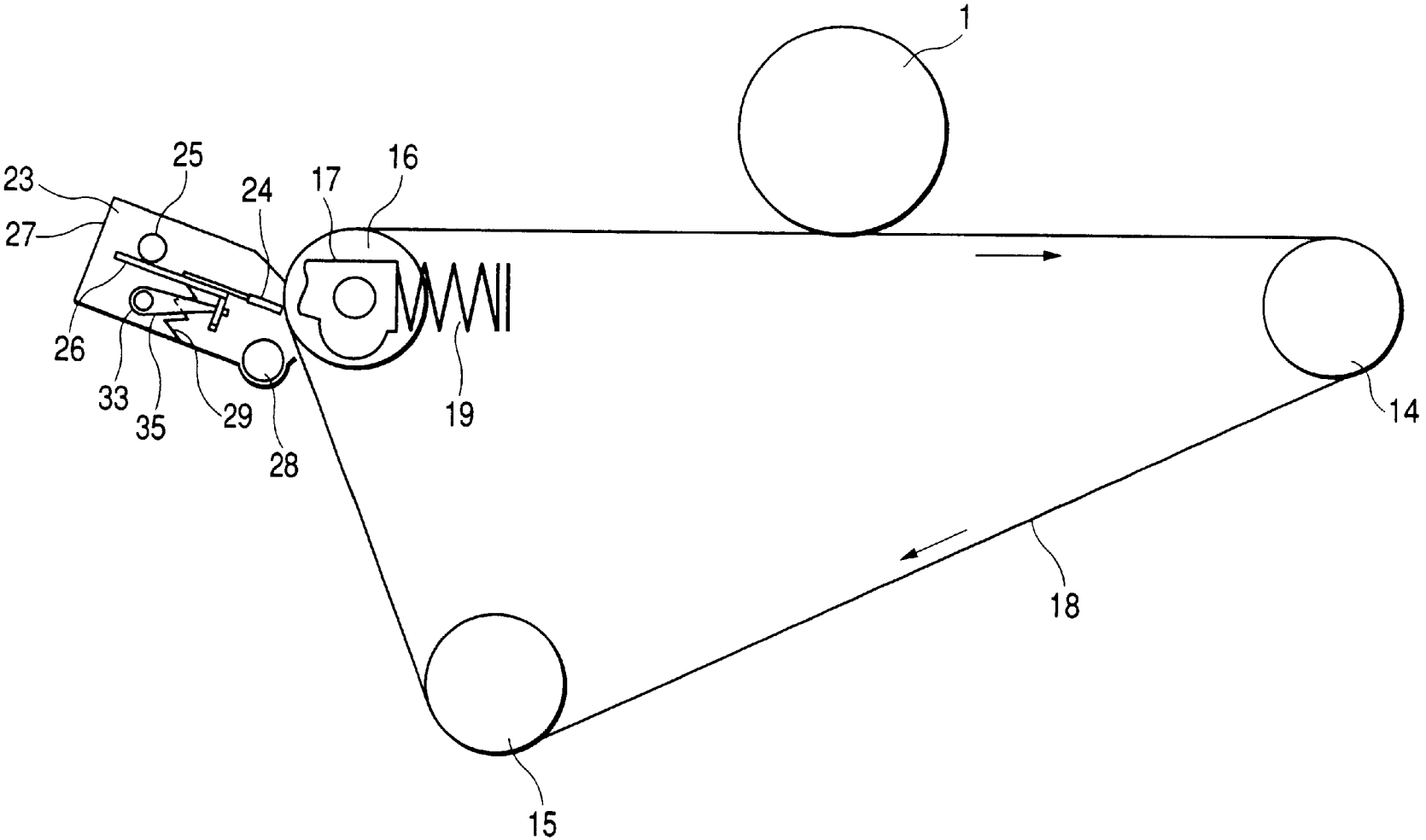
FIG. 3 is a cross-sectional view showing the relation of an intermediate transfer unit and a cleaner unit in the present invention.

As shown in FIG. 3, the intermediate transfer belt 18 is tensioned by three shafts of the drive roller 14, the secondary transfer opposite roller 15 and the tension roller 16. The tension roller 16 is pressurized by a spring pressure of the compression spring 19 so that a change in circumferential length of the intermediate transfer belt 18 due to change in temperature and humidity within the main body or variation per hour is absorbed. Further, the driving force of an unillustrated drive motor is transmitted to one rear end of the drive roller 14 in FIG. 3 so that the intermediate transfer belt 18 is rotated at a predetermined peripheral speed in the clockwise direction in FIG. 3 in accordance with an image forming operation.

The cleaning blade 24 for cleaning the intermediate transfer belt 18 is arranged in an opposite portion of the above tension roller 16 in the above cleaner container 27. The cleaning blade 24 is retained such that the cleaning blade 24 abuts against the intermediate transfer belt 18 by a predetermined angle with a swinging shaft 25 as a center of rotation (counter abutting). The above cleaning blade 24 abuts against the intermediate transfer belt 18 by a predetermined abutting pressure by the compression spring 29. The above cleaning blade 24 is also fixed to a blade retaining plate 26.

Figure 4:
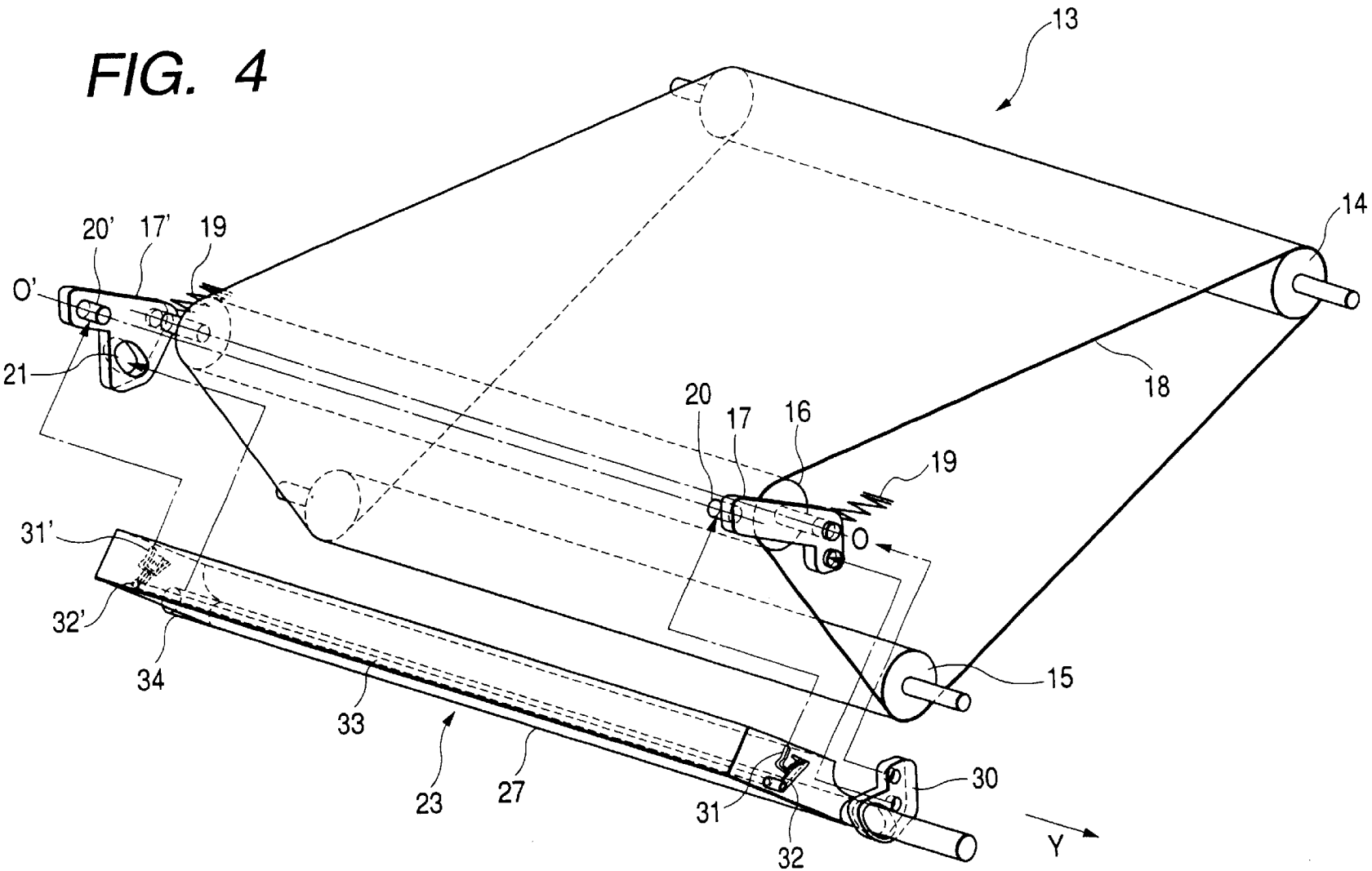
FIG. 4 is a perspective view showing the relation of the intermediate transfer unit and the cleaner unit in the present invention.

As shown by the perspective view of FIG. 4, bosses 20, 20' for positioning a cleaner unit 23 are arranged in two places of the intermediate transfer member unit 13. The above bosses 20, 20' are formed integrally with bearing members 17, 17' in both end portions of the above tension roller 16. An axial line 0 of the tension roller shaft 16*a* and a line 0' connecting axial lines of the above both bosses 20, 20' are maintained in parallel at any time even when the above tension roller 16 is moved. A round elongated hole 21 is formed in one portion of the rear tensioner 17' in FIG. 4, and a screw drive input portion 34 of the above cleaner unit 23 is fitted into this round elongated hole 21. When the above cleaner unit 23 is set, the round elongated hole 21 functions as a detent. A front detent member 30 in FIG. 4 is arranged in the above cleaner unit 23. This detent member 30 is positioned in one portion of the above front tensioner 17 in FIG. 4. Further, the above bosses 20, 20' are respectively fitted into positioning grooves 31, 31' formed in the above cleaner unit 23, and the above cleaner unit 23 can be positioned in the above intermediate transfer member unit 13 by latches 32, 32'.

Figure 5:
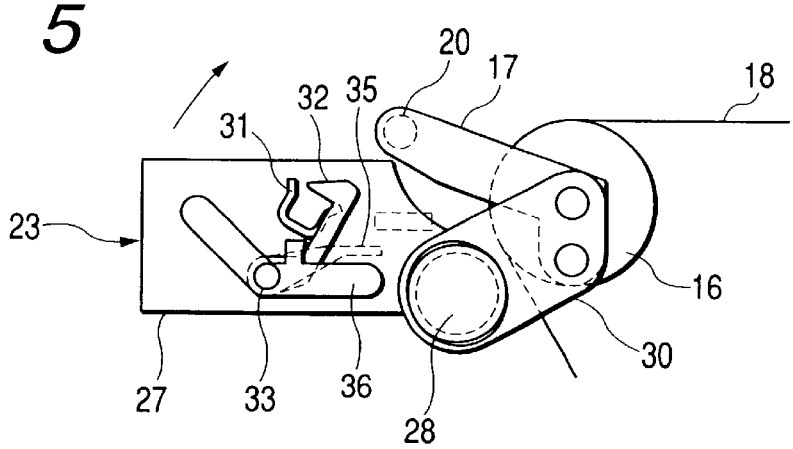
FIG. 5 is a side view showing a method for attaching and detaching the cleaner unit of the present invention.
Figure 6:
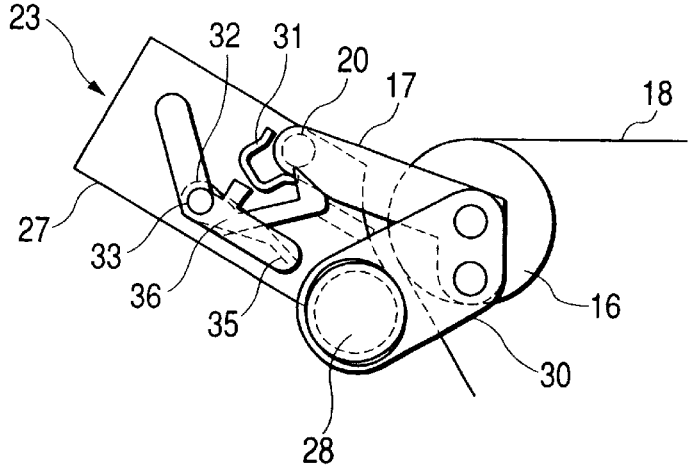
FIG. 6 is a side view showing the method for attaching and detaching the cleaner unit of the present invention.
Figure 7:
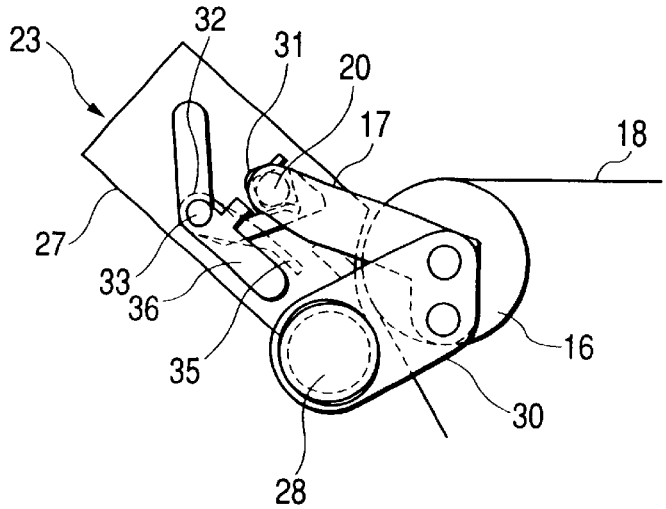
FIG. 7 is a side view showing the method for attaching and detaching the cleaner unit of the present invention.
Figure 8:
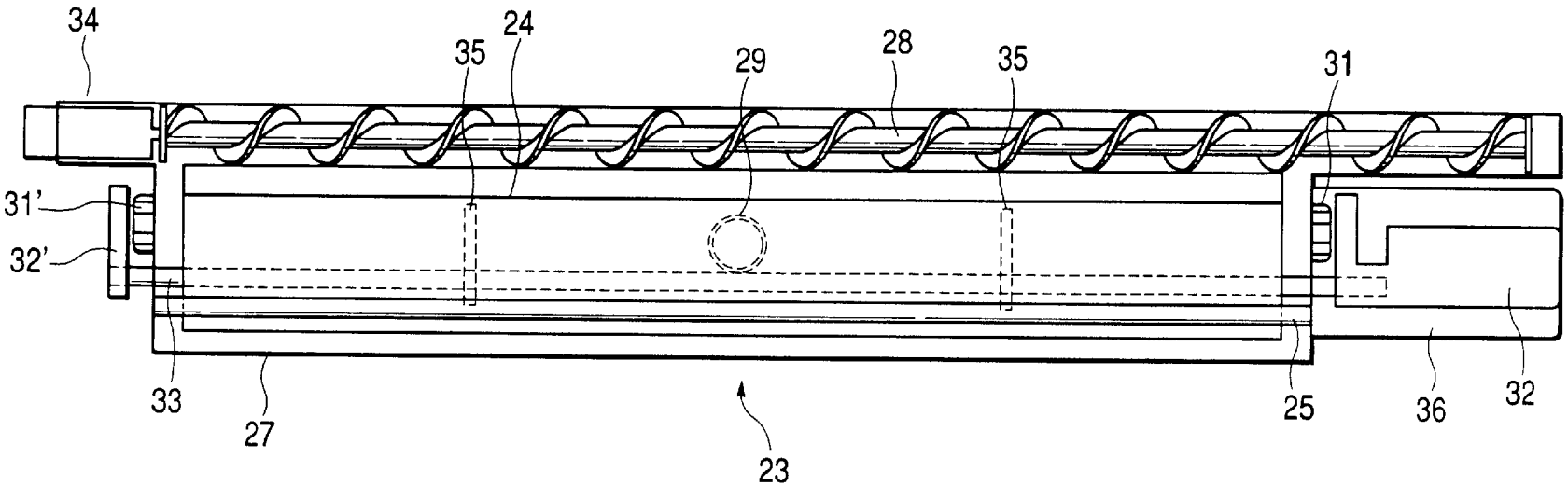
FIG. 8 is a top view showing the cleaner unit of the present invention.

In a method for setting the above cleaner unit 23, as shown in FIGS. 5 to 7 (front views) and FIG. 8 (top view), the cleaner unit 23 is inserted into the main body from the front in a separating state in a direction perpendicular to a paper conveying direction. The cleaner unit 23 is inserted until the cleaner unit 23 comes in contact with an unillustrated hitting portion in a rear portion of the above intermediate transfer member unit 13. In an inserted state, a lever 36 arranged in the above cleaner unit 23 is gripped and rotated about a waste toner conveying screw shaft and is pushed upward until the above latches 32, 32' are respectively engaged with the above bosses 20, 20'. When the cleaner unit 23 is conversely taken out, the above latches 32, 32' are released by the lever 36 also serving as a latch release lever so that the above cleaner unit 23 is set to the separating state and is pulled out forward.

The waste toner collected by the above cleaning blade 24 is conveyed forward by a waste toner conveying screw 28 arranged in a lowermost portion of the cleaner container 27. The waste toner then drops and is collected from a connecting portion of the above cleaner container 27 and a waste toner bottle 37 into this waste toner bottle 37. The above waste toner conveying screw 28 is rotated by the driving force of an unillustrated drive motor transmitted to a drive input portion 34 at one rear end of the conveying screw 28.

A drive source of the above waste toner conveying screw 28 is set to a fixing drive source, and thus the number of motors can be reduced so that the structure is simplified.

The cleaner unit 23 is separated from the intermediate transfer unit by the above lever 36, and is guided by a rail member arranged on a side of the main body of the apparatus, and can be detachably attached to the apparatus main body in a Y-direction in FIG. 4.

When lives of the intermediate transfer belt 18 and the cleaner unit 23 are not in conformity with each other, it is inefficient to simultaneously exchange both the units. Accordingly, both units are detachably constructed.

Second Embodiment

The above construction is not limited to the intermediate transfer belt, but is also effective with respect to a photosensitive belt and a transfer belt.

Figure 9:
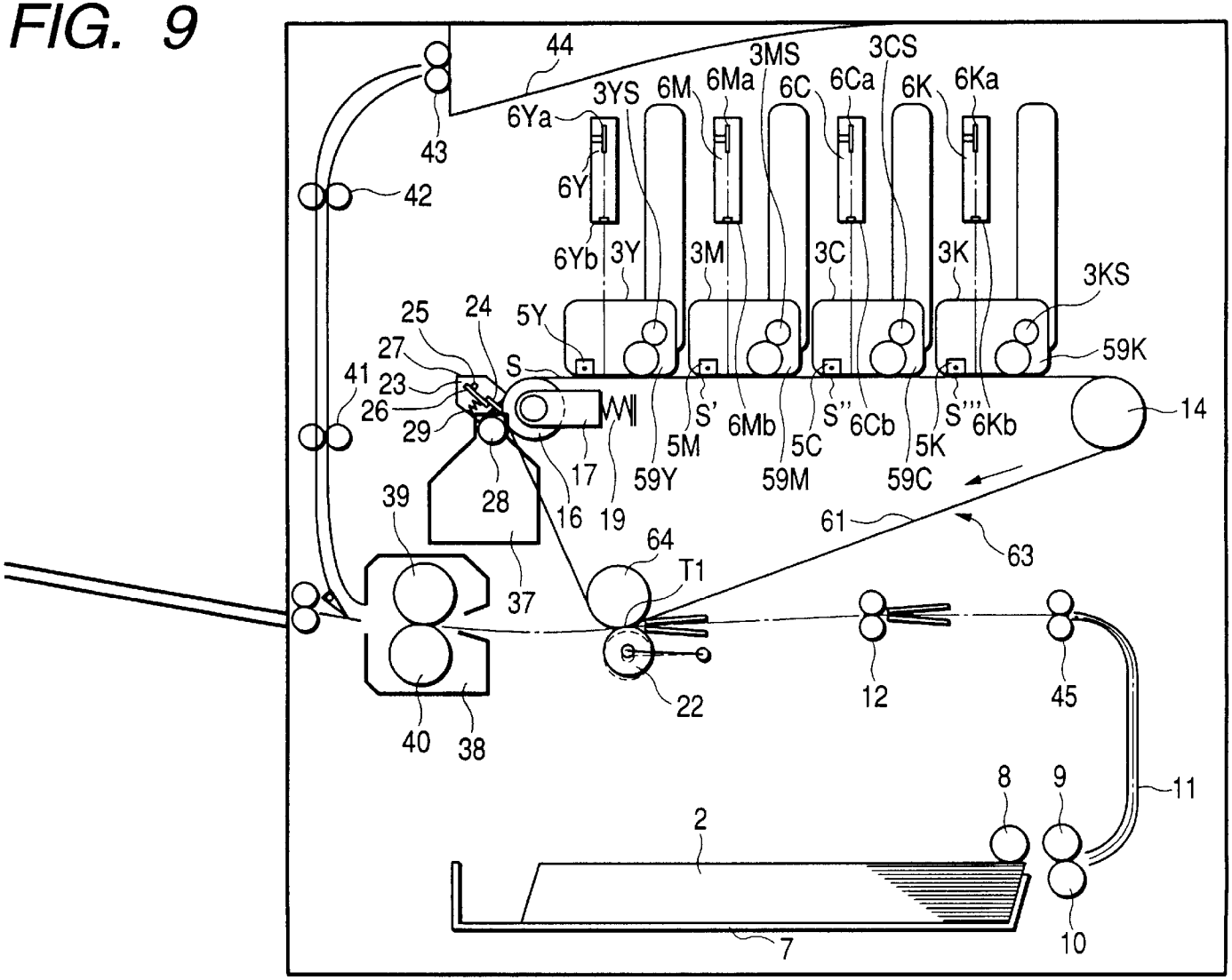
FIG. 9 is a main sectional view schematically showing the entire construction of an image forming apparatus using a photosensitive belt unit in a second embodiment of the present invention.

FIG. 9 is a view of a full color image forming apparatus using a photosensitive belt in a second embodiment of the present invention. Image formation of this image forming apparatus will next be explained. As shown in FIG. 9, a cassette 7 for stacking and containing plural sheets of transfer material 2 is detachably mounted to the image forming apparatus and the transfer materials 2 are fed by a pickup roller 8. The fed transfer materials 2 are separated from each other one by one by a retard roller pair 9, 10 and are conveyed to a registration roller pair 12 by a conveying roller 45. When the transfer material 2 is conveyed, the rotation of the registration roller is stopped and skew feed of the transfer material 2 is corrected by making the transfer material 2 hit against a nip portion of the registration roller. As shown in FIG. 9, developing cartridges 59Y, 59M, 59C, 59K of four colors of cyan, magenta, yellow and black are arranged in parallel with each other. Optical scanning systems 6Y, 6M, 6C, 6K corresponding to the respective developing cartridges are arranged. A latent image is formed on a photosensitive belt 61 by an image signal every color, and a toner image formed by each developing cartridge is laminated so that a full color toner image is formed. Here, in the construction of a photosensitive belt unit 63, the photosensitive belt 61 is tensioned by three shafts of a drive roller 14, a transfer opposite roller 64 and a tension roller 16, and tensile force is given to the photosensitive belt 61 by pressurizing the tension roller 16 by a compression spring 19. Thereafter, the transfer material 2 is sent out to a transfer roller 22 at a predetermined timing and the toner image on the photosensitive belt 61 is transferred onto the transfer material 2 and is fixed by a fixing device 38. Thereafter, the transfer material 2 is discharged and stacked onto a discharge tray 44 by discharge roller pairs 41, 42, 43.

In this embodiment, similar to the first embodiment, a cleaner unit 23 is fixedly positioned in a tensioner 17. Thus, an abutting angle of a cleaning blade on the belt, an inroad amount of a cleaning blade tip with respect to the belt, etc. can be maintained. Accordingly, preferable cleaning performance can be maintained and an output image of high quality can be obtained.

Third Embodiment

Figure 10:
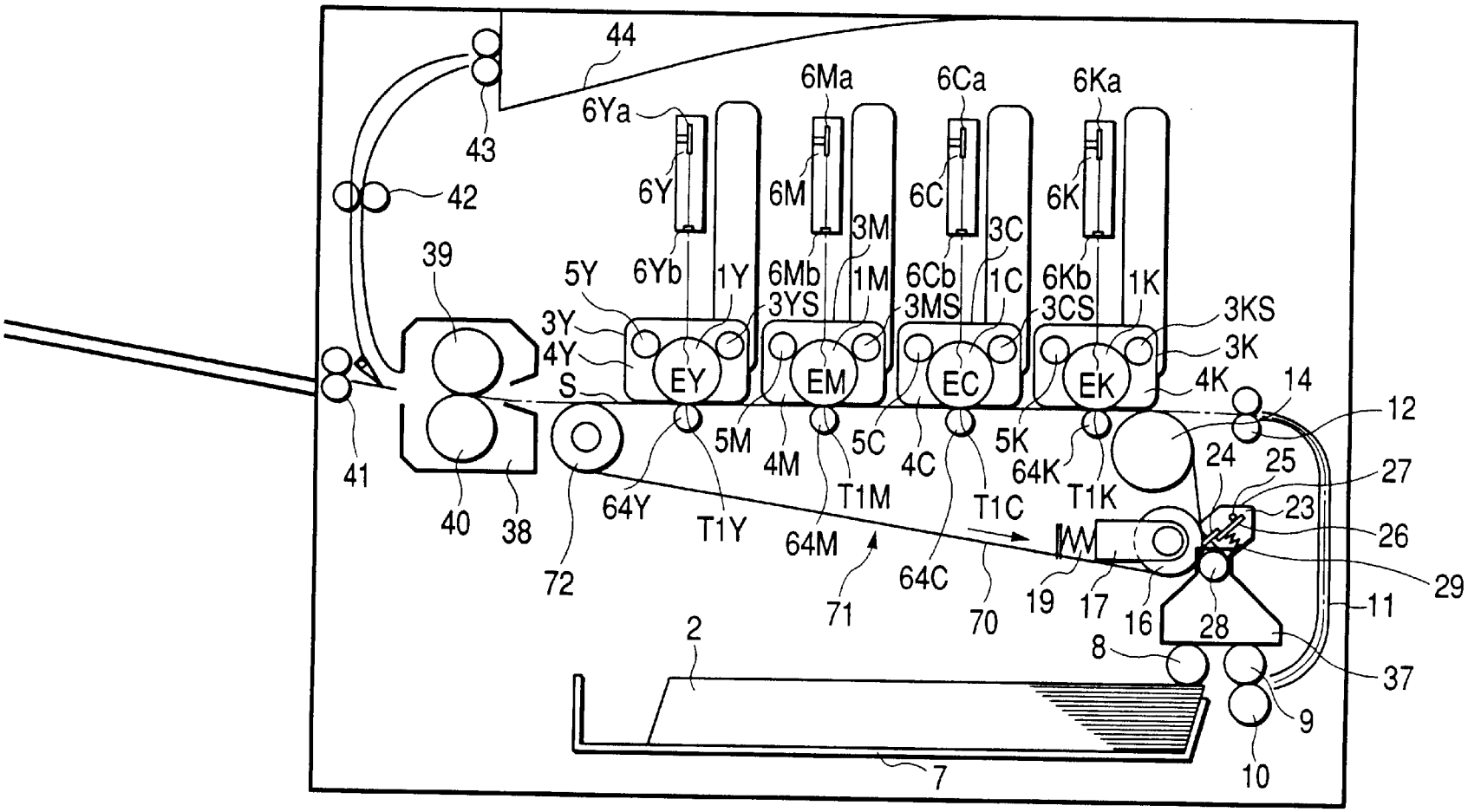
FIG. 10 is a main sectional view schematically showing the entire construction of an image forming apparatus using a transfer belt unit in a third embodiment of the present invention.
Figure 11:
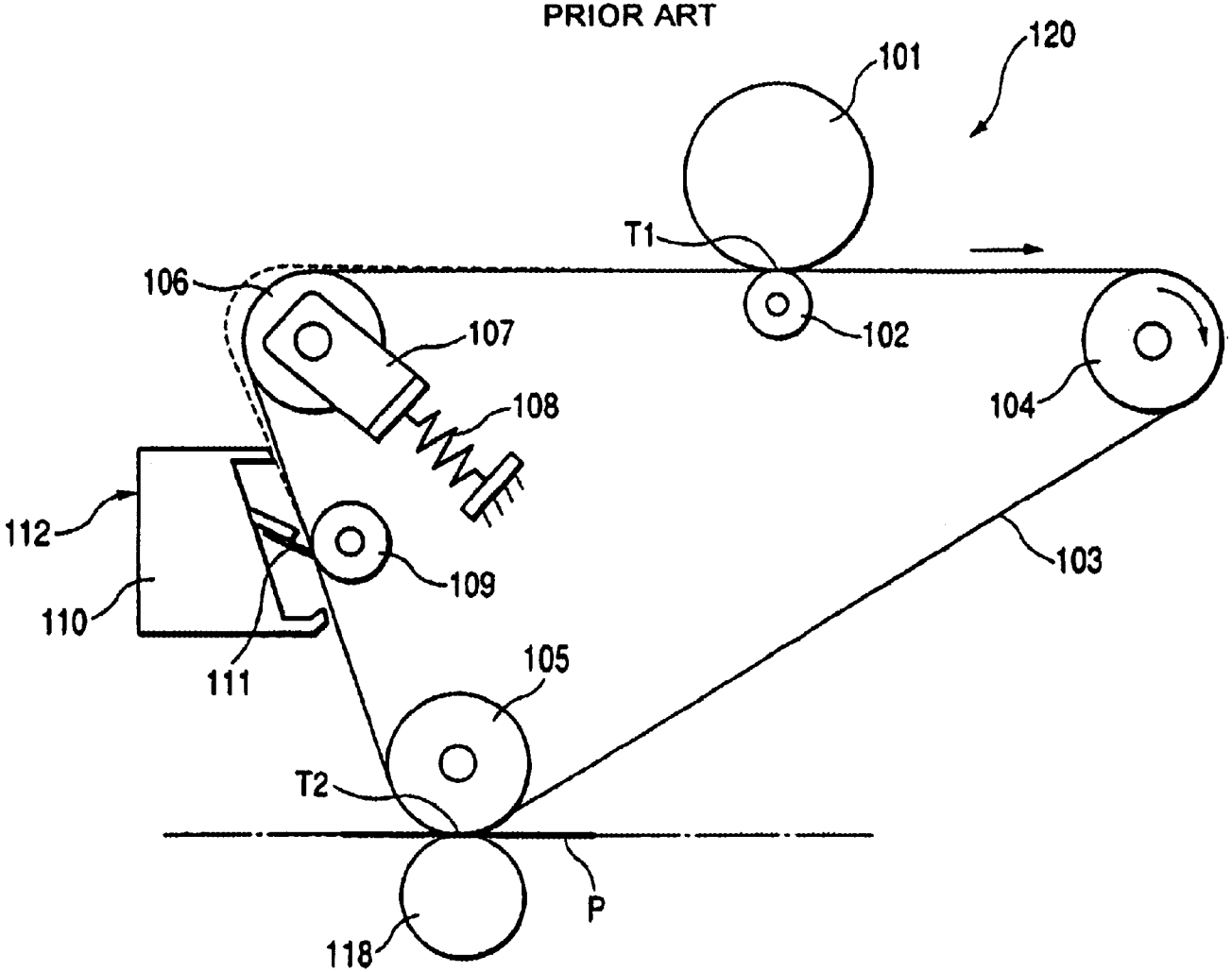
FIG. 11 PRIOR ART
FIG. 11 is a main sectional view showing a conventional example.

The cleaning performance can also be maintained by a similar construction in a full color image forming apparatus using a transfer belt in a third embodiment. FIG. 10 is a view of such a full color image forming apparatus using the transfer belt in the third embodiment of the present invention. Image formation of this image forming apparatus will be explained.

First, as shown in FIG. 10, a cassette 7 for stacking and containing plural sheets of transfer material 2 is detachably mounted to the image forming apparatus. The transfer materials 2 are fed by a pickup roller 8 and are separated from each other one by one by a retard roller pair 9, 10 and are conveyed to a registration roller pair 12. When the transfer material 2 is conveyed, the rotation of the registration roller is stopped and skew feed of the transfer material 2 is corrected by making the transfer material 2 hit against a nip portion of the registration roller. In the case of a four-drum full color system, process cartridges 4Y, 4M, 4C, 4K of four colors of cyan, magenta, yellow and black including image bearing members are arranged in parallel with each other as shown in FIG. 10. Optical scanning systems 6Y, 6M, 6C, 6K are respectively arranged with respect to the process cartridges. A toner image is formed on the image bearing member by an image signal every color. Thereafter, each toner image is sequentially transferred onto the transfer material 2 conveyed on a transfer belt 70. At this point, a primary transfer opposite roller 64 is arranged in every color. The transfer material 2 is sent out onto the transfer belt 70 at a predetermined timing. The toner image on each image bearing member is sequentially superimposed and transferred onto the transfer material 2 and is fixed by a fixing device 38. Thereafter, the transfer material 2 is discharged and stacked onto a discharge tray 44 by discharge roller pairs 41, 42, 43.

Here, in a transfer belt unit 71, the transfer belt 70 is tensioned by three shafts of a drive roller 14, a roller 72 and a tension roller 16. Tensile force is given to the transfer belt 61 by pressurizing the tension roller 16 by a compressing spring 19.

In this embodiment, similar to the first and second embodiments, preferable cleaning performance can be maintained and an output image of high quality can be obtained by fixedly positioning the cleaner unit 23 in the tensioner 17.

In the above embodiments, description was made of a belt member surface cleaned by the cleaning blade. However, the present invention is not limited to this case, but can also be applied when a cleaning brush is used. Further, the tension roller is used as an opposite roller of the cleaning blade. However, the present invention is not limited to this case, but can also be applied when an alignment roller for adjusting deviation of the belt member in a direction perpendicular to a moving direction by moving one end side of a rotating shaft of the roller is used as the opposite roller.

As explained above, in accordance with the present invention, the cleaning unit is positioned in a retaining member for retaining a roller. Accordingly, an abutting condition (abutting angle, etc.) of the cleaning member on the belt member is maintained even when the roller retained by the retaining member is moved. Therefore, a cleaning defect can be prevented.

Further, it is not necessary to separately arrange an opposite member of the cleaning member so that the image forming apparatus can be made compact and can be simplified and reduced in cost.

What is claimed is:

1. An image forming apparatus comprising:

a movable belt member;

a roller for supporting said belt member;

retaining means for retaining said roller, wherein said roller is movable in a predetermined direction together with said retaining means;

a cleaning unit including a cleaning member for cleaning said belt member in contact with a surface of said belt member;

a belt unit including said belt member, said roller, and said retaining means, wherein said cleaning unit is detachably attachable to said belt unit, and said cleaning unit is positioned in said retaining means when said cleaning unit is to be attached to said belt unit, and wherein said cleaning member is rotatable about an axis.

2. An image forming apparatus according to claim 1, wherein said roller is movable in a moving direction of said belt member so as to adjust a tensile force of said belt member.

3. An image forming apparatus according to claim 1, wherein said roller is movable in the a moving direction of said belt member so as to regulate a deviation in a direction perpendicular to the moving direction of said belt member.

4. An image forming apparatus according to claim 1, wherein a contact position of said cleaning member is not substantially changed even when said roller is moved.

5. An image forming apparatus according to claim 1, wherein said retaining means includes a pair of retaining members for retaining both end portions of a rotating shaft of said roller.

6. An image forming apparatus according to claim 1, wherein said belt unit includes supporting means for supporting said retaining means such that said retaining means is movable in the predetermined moving direction of said belt member.

7. An image forming apparatus according to claim 6, wherein said retaining means includes a pair of retaining members for respectively retaining both end portions of a rotating shaft of said roller, and wherein said supporting means includes a pair of supporting members for respectively supporting said both end portions of said rotating shaft.

8. An image forming apparatus according to claim 7, wherein each of said supporting members includes a hole for guiding said rotating shaft, and wherein a guiding direction of said rotating shaft is a direction taken in the moving direction of said belt member.

9. An image forming apparatus according to claim 1, wherein said cleaning member includes a blade.

10. An image forming apparatus according to claim 9, wherein said blade is oriented toward an upstream side in a moving direction of said belt member so as to be in contact with said belt member.

11. An image forming apparatus according to claim 9, wherein said blade is contactable with said belt member with a predetermined pressure.

12. An image forming apparatus according to claim 1, wherein said cleaning member includes a rotatable brush.

13. An image forming apparatus according to claim 12, wherein said brush is contactable with said belt member with a predetermined pressure.

14. An image forming apparatus according to claim 1, wherein said image forming means includes an image bearing member for bearing the image, and wherein the image is transferred from said image bearing member onto said belt member, and then transferred from said belt member onto a recording material.

15. An image forming apparatus according to claim 1, wherein said image forming means includes a plurality of image bearing members for respectively bearing a plurality of color images, and the plurality of color images are sequentially transferred from said respective image bearing members onto said belt member, and then transferred from said belt member onto a recording material.

16. An image forming apparatus according to claim 1, wherein said cleaning unit includes a container for containing a substance collected by said cleaning member.

17. An image forming apparatus according to claim 1, wherein said cleaning unit is detachably attached to said retaining means.

18. An image forming apparatus according to claim 1, wherein said cleaning member is opposed to said roller through said belt member.

19. An image forming apparatus according to claim 1, wherein said retaining means retains a rotating shaft of said roller.

20. An image forming apparatus according to claim 1, further comprising image forming means for forming an image on said belt member.

21. An image forming apparatus according to claim 20, wherein said belt member is a photosensitive belt.

22. An image forming apparatus according to claim 20, wherein said belt member is an intermediate transfer belt.

23. An image forming apparatus according to claim 20, wherein the image on said belt member is transferred onto a recording material.

24. An image forming apparatus according to claim 1, wherein said belt member bears and conveys a recording material.

25. An image forming apparatus according to claim 24, further comprising image forming means for forming an image on the recording material borne on said belt member.

26. An image forming apparatus according to claim 1, wherein said cleaning unit includes urging means for urging said cleaning member toward said belt member.

* * * * *

UNITED STATES PATENT AND TRADEMARK OFFICE

CERTIFICATE OF CORRECTION

PATENT NO. : 6,704,528 B1
DATED : March 9, 2004
INVENTOR(S) : Hiroshi Kawamura et al.

It is certified that error appears in the above-identified patent and that said Letters Patent is hereby corrected as shown below:

Column 3,
Line 50, “each every” should read -- for every --.

Column 4,
Line 55, “synchronizm” should read -- synchronism --.

Column 5,
Line 53, “nizm” should read -- nism --.

Column 7,
Line 48, “TiC.” should read -- T1C. --.

Column 10,
Line 43, “every color,” should read -- for every color, --.

Column 11,
Line 21, “every color.” should read -- for every color. --.

Column 12,
Line 3, “member;” should read -- member; and --; and
Line 16, “the” should be deleted.

Signed and Sealed this

Thirteenth Day of July, 2004

JON W. DUDAS
*Acting Director of the United States Patent and Trademark Office*